US008651645B2

(12) United States Patent
Urlaub et al.

(10) Patent No.: US 8,651,645 B2
(45) Date of Patent: Feb. 18, 2014

(54) PRINT CARTRIDGE IDENTIFICATION SYSTEM AND METHOD

(75) Inventors: Kevin J. Urlaub, Boise, ID (US); David A. Bradley, Jr., Boise, ID (US); Roger W. Squire, Boise, ID (US); Donald B. Ouchida, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 316 days.

(21) Appl. No.: 12/915,523

(22) Filed: Oct. 29, 2010

(65) Prior Publication Data

US 2012/0105519 A1 May 3, 2012

(51) Int. Cl.
*B41J 2/175* (2006.01)

(52) U.S. Cl.
CPC ..... *B41J 2/1755* (2013.01); *B41J 2/17503* (2013.01)
USPC ..... 347/87

(58) Field of Classification Search
USPC ..... 347/86, 87
See application file for complete search history.

(56) References Cited

U.S. PATENT DOCUMENTS

| | | | | |
|---|---|---|---|---|
| 4,907,019 | A | 3/1990 | Stephens | |
| 5,519,422 | A | 5/1996 | Thoman et al. | |
| 5,880,764 | A | 3/1999 | Barinaga | |
| 5,956,057 | A | 9/1999 | Childers et al. | |
| 6,017,118 | A | 1/2000 | Gasvoda et al. | |
| 6,151,041 | A | 11/2000 | Bolash et al. | |
| 6,276,788 | B1 | 8/2001 | Hilton | |
| 6,290,346 | B1 | 9/2001 | Santhanam et al. | |
| 6,364,462 | B1 | 4/2002 | Furukawa et al. | |
| 6,364,472 | B1 | 4/2002 | Hmelar et al. | |
| 6,431,697 | B1 | 8/2002 | King et al. | |
| 6,477,335 | B1 | 11/2002 | Surya et al. | |
| 6,547,378 | B2 | 4/2003 | Santhanam et al. | |
| 6,702,435 | B2 * | 3/2004 | Perkins et al. | 347/86 |
| 6,749,294 | B2 | 6/2004 | Haldorsen | |
| 6,938,997 | B2 | 9/2005 | Toba et al. | |
| 6,942,328 | B2 | 9/2005 | Haldorsen | |
| 7,152,939 | B2 | 12/2006 | Silverbrook | |
| 7,156,491 | B2 * | 1/2007 | Sturgeon et al. | 347/49 |
| 7,192,129 | B2 | 3/2007 | Droege et al. | |
| 7,324,762 | B2 | 1/2008 | Harumoto | |
| 7,370,950 | B2 * | 5/2008 | Amemiya | 347/86 |
| 2008/0180495 | A1 * | 7/2008 | Gonzales | 347/86 |

FOREIGN PATENT DOCUMENTS

| | | |
|---|---|---|
| CN | 100410820 | 8/2008 |
| JP | 08-300803 | 11/1996 |

* cited by examiner

*Primary Examiner* — Julian Huffman
*Assistant Examiner* — Sharon A Polk

(57) ABSTRACT

A print cartridge identification system includes a housing, a family key provided on one side of the housing to identify an associated printer of the print cartridge, a fluid key provided on the one side of the housing to identify a property of fluid in the print cartridge, and a location datum provided on the one side of the housing to position the print cartridge in the associated printer.

13 Claims, 10 Drawing Sheets

PRINT CARTRIDGE IDENTIFICATION SYSTEM AND METHOD

BACKGROUND

A print cartridge for an inkjet printing system may include a printhead and an ink supply which supplies ink to the printhead such that properly sequenced ejection of drops of ink from the printhead causes characters or other images to be printed upon a print medium as the print cartridge and the print medium are moved relative to each other. The print cartridge may be supported by a carriage that, in one implementation, traverses the print medium from side-to-side during printing operations or, in another implementation, remains stationary as the print medium is moved during printing operations. Unfortunately, wrongful or improper insertion of a print cartridge into the carriage may be harmful.

DETAILED DESCRIPTION

In the following detailed description, reference is made to the accompanying drawings which form a part hereof, and in which is shown by way of illustration specific embodiments in which the disclosure may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Figure 1:
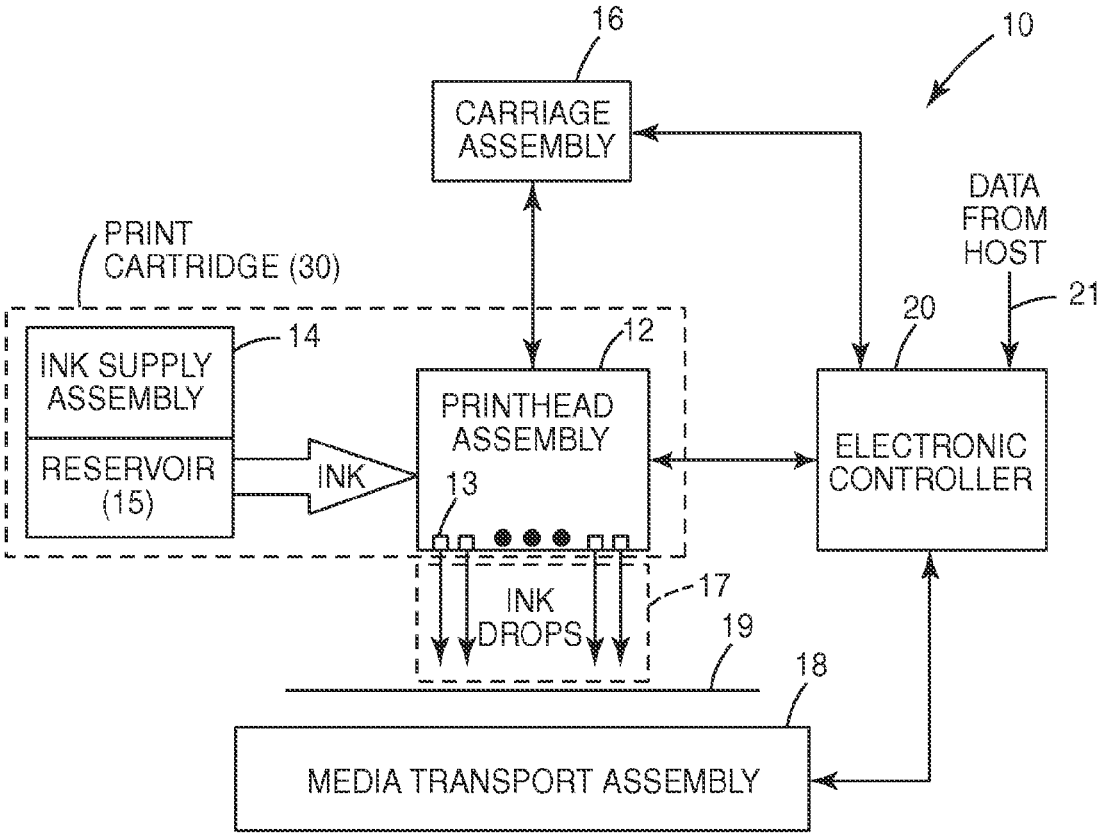
FIG. 1 is a block diagram illustrating one embodiment of an inkjet printing system.

FIG. 1 illustrates one embodiment of an inkjet printing system 10. Inkjet printing system 10 constitutes one embodiment of a fluid ejection system which includes a fluid ejection assembly, such as an inkjet printhead assembly 12, and a fluid supply assembly, such as an ink supply assembly 14. In the illustrated embodiment, inkjet printing system 10 also includes a carriage assembly 16, a media transport assembly 18, and an electronic controller 20.

Inkjet printhead assembly 12, as one embodiment of a fluid ejection assembly, includes one or more printheads or fluid ejection devices which eject drops of ink or fluid through a plurality of orifices or nozzles 13. In one embodiment, the drops are directed toward a medium, such as print medium 19, so as to print onto print medium 19. Print medium 19 is any type of suitable sheet material, such as paper, card stock, transparencies, Mylar, fabric, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14, as one embodiment of a fluid supply assembly, supplies ink to inkjet printhead assembly 12 and includes a reservoir 15 for storing ink. As such, in one embodiment, ink flows from reservoir 15 to inkjet printhead assembly 12. In one embodiment, inkjet printhead assembly 12 and ink supply assembly 14 are housed together in an inkjet or fluid-jet print cartridge or pen, as identified by dashed line 30. In another embodiment, ink supply assembly 14 is separate from inkjet printhead assembly 12 and supplies ink to inkjet printhead assembly 12 through an interface connection, such as a supply tube.

Carriage assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly such that carriage assembly 16 moves inkjet printhead assembly 12 relative to media transport assembly 18. In another embodiment, inkjet printhead assembly 12 is a non-scanning type printhead assembly such that carriage assembly 16 fixes inkjet printhead assembly 12 at a prescribed position relative to media transport assembly 18.

Electronic controller 20 communicates with inkjet printhead assembly 12, carriage assembly 16, and media transport assembly 18. Thus, in one embodiment, when inkjet printhead assembly 12 is mounted in carriage assembly 16, electronic controller 20 and inkjet printhead assembly 12 communicate via carriage assembly 16.

Electronic controller 20 receives data 21 from a host system, such as a computer, and may include memory for temporarily storing data 21. Data 21 may be sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry forming a portion of electronic controller 20 is located off inkjet printhead assembly 12.

Figure 2:
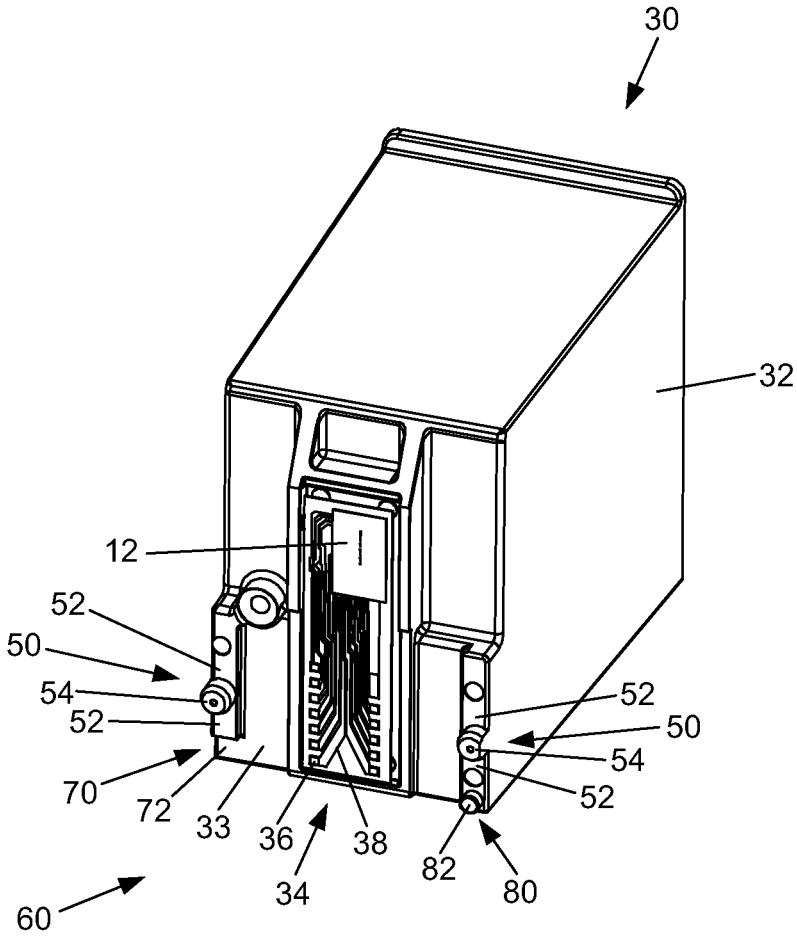
FIG. 2 is a perspective view illustrating one embodiment of a print cartridge for an inkjet printing system.

FIG. 2 illustrates one embodiment of print cartridge 30. Print cartridge 30 includes a housing 32 which supports inkjet printhead assembly 12 and contains reservoir 15 of ink supply assembly 14 (FIG. 1). As such, reservoir 15 communicates with inkjet printhead assembly 12 to supply ink to inkjet printhead assembly 12. In addition, housing 32 supports an electrical circuit 34 which facilitates communication of electrical signals between electronic controller 20 and inkjet printhead assembly 12 for controlling and/or monitoring operation of inkjet printhead assembly 12.

Electrical circuit 34 of print cartridge 30 includes a plurality of electrical contacts 36 and a plurality of conductive paths 38 which extend between and provide electrical connection between electrical contacts 36 and inkjet printhead assembly 12. As such, electrical contacts 36 provide points for electrical connection with print cartridge 30 and, more specifically, inkjet printhead assembly 12. In one embodiment, electrical contacts 36 and inkjet printhead assembly 12 are provided along a same side 33 of housing 32 of print cartridge 30. In addition, inkjet printhead assembly 12 is configured to eject drops of ink in a direction substantially perpendicular to the front face of inkjet printhead assembly 12 such that inkjet printhead assembly 12 ejects drops of fluid or ink in a direction substantially perpendicular to side 33 of housing 32.

Figure 3:
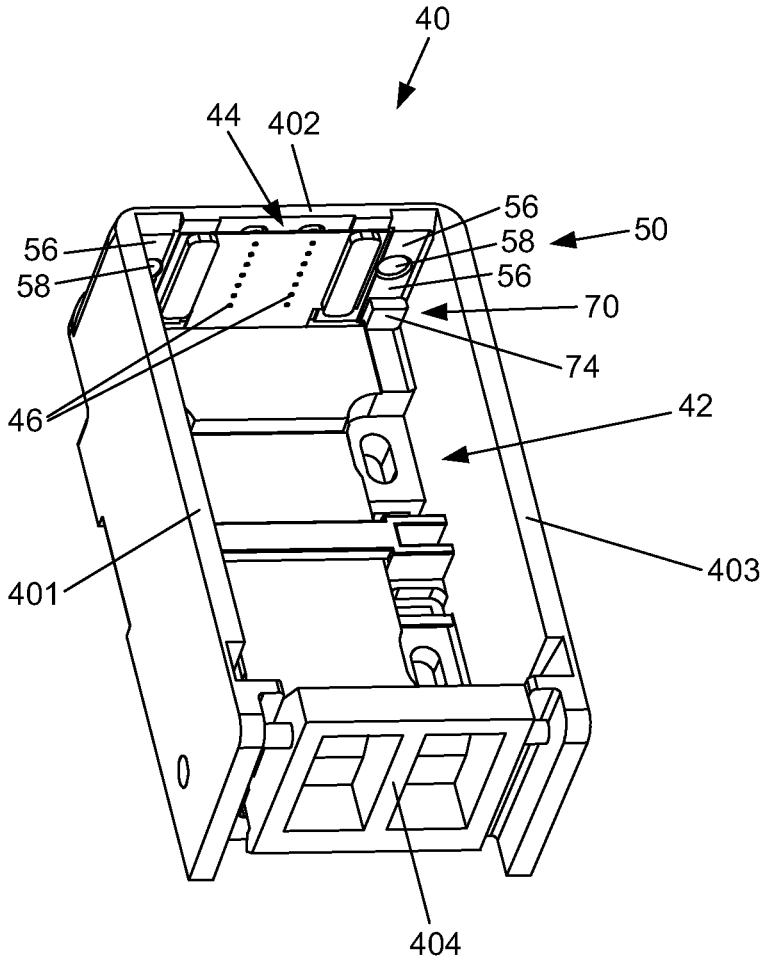
FIG. 3 is a perspective view illustrating one embodiment of a carriage for a print cartridge of an inkjet printing system.

FIG. 3 illustrates one embodiment of a portion of carriage assembly 16 including a carriage 40 and an electrical circuit 44. Carriage 40 defines a carriage stall 42 for print cartridge 30 such that carriage stall 42 is sized and configured to receive and support print cartridge 30. In one embodiment, carriage 40 is slidably mounted within inkjet printing system 10 for lateral movement such that carriage 40 moves print cartridge 30 back and forth across print medium 19 (FIG. 1).

In one embodiment, carriage 40 includes sidewalls 401 and 403, an end wall 402, and a latch 404 which define carriage stall 42. Print cartridge 30 is installed and/or positioned in carriage 40 and, more specifically, inserted into carriage stall 42 in a direction toward end wall 402, such that side 33 of housing 32 is adjacent end wall 402 of carriage 40. As such, latch 404 is movable between an open position (not shown) and a closed position (as illustrated in FIG. 3) to secure print cartridge 30 within carriage 40. While carriage assembly 16 and, more specifically, carriage 40 is illustrated as including one carriage stall 42, it is understood that carriage assembly 16 may include any number of carriage stalls 42. In addition, multiple carriage stalls 42 may accommodate, for example, multiple print cartridges 30 which may include differing types or colors of fluid or ink.

Electrical circuit 44 of carriage 40 facilitates communication of electrical signals between electronic controller 20 and print cartridge 30. More specifically, electrical circuit 44 facilitates communication of electrical signals between electronic controller 20 and inkjet printhead assembly 12 for controlling and/or monitoring operation of inkjet printhead assembly 12. In one embodiment, electrical circuit 44 is provided along end wall 402 of carriage 40 and includes a plurality of electrical contacts 46, such that electrical contacts 36 of print cartridge 30 contact electrical contacts 46 of carriage 40 when print cartridge 30 is installed in carriage stall 42. Electrical circuit 44 communicates with electronic controller 20 such that electrical signals are communicated between electronic controller 20 and print cartridge 30 via electrical contacts 46 when print cartridge 30 is installed in carriage stall 42.

Figure 4:
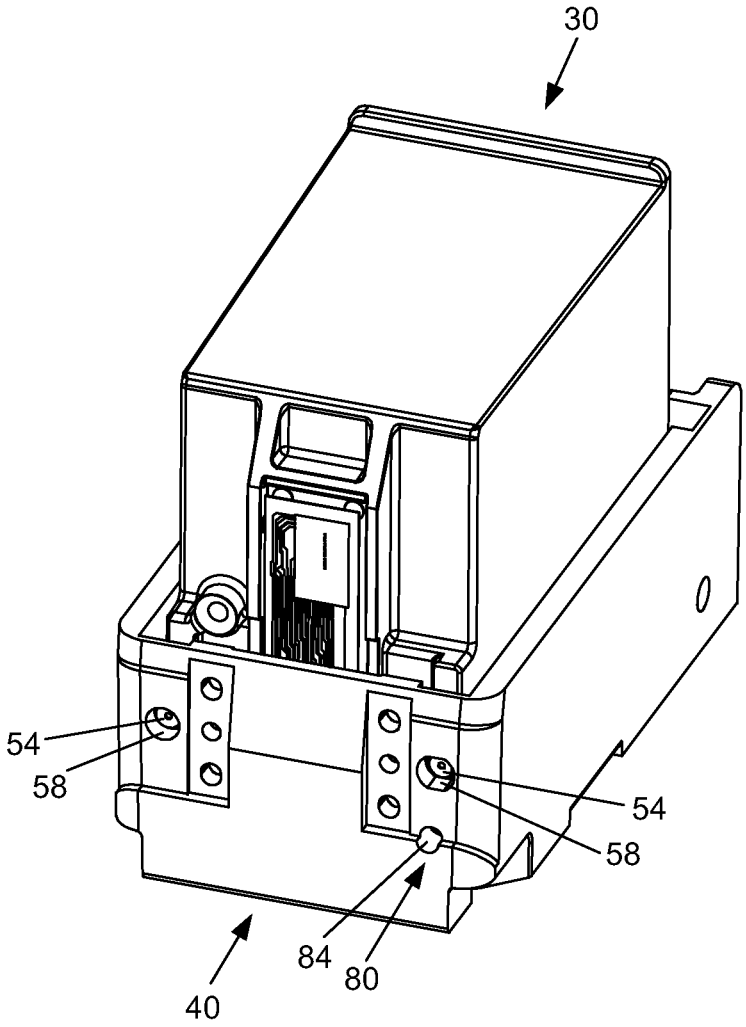
FIG. 4 is a perspective view illustrating one embodiment of the print cartridge of FIG. 2 in the carriage of FIG. 3.

As illustrated in the embodiments of FIGS. 2-4, print cartridge 30 and carriage 40 include one or more location datums 50 that provide alignment features on mating surfaces of print cartridge 30 and carriage 40 to position and/or locate print cartridge 30 within and/or relative to carriage 40. In one embodiment, location datums 50 include surfaces 52 and protrusions 54 of housing 32 which mate with corresponding surfaces 56 and receptacles 58 of carriage 40 to position or locate print cartridge 30 in carriage 40. More specifically, location datums 50 align print cartridge 30 in carriage 40 when print cartridge 30 is inserted into carriage 40. In one embodiment, location datums 50 are provided on side 33 of housing 32 including, more specifically, on opposite edges of side 33 of housing 32. Although location datums 50 are illustrated as including one protrusion or one receptacle and two adjacent surfaces, it is understood that location datums 50 may be defined by any number and/or configuration or arrangement of mating or interacting protrusions or receptacles and/or surfaces.

In one embodiment, as illustrated in FIGS. 2-4, print cartridge 30, in association with carriage 40, includes a print cartridge identification system 60. More specifically, print cartridge 30 and carriage 40 include a mating and corresponding system of identifying or keying print cartridge 30 for use with carriage 40. As such, print cartridge identification system 60 helps to prevent wrongful or improper insertion of print cartridge 30 into carriage 40. As described below, print cartridge identification system 60 uses corresponding positive and negative physical features provided on print cartridge 30 and carriage 40 to allow only properly identified or keyed print cartridges 30 to be inserted into carriage 40. The corresponding positive and negative physical features of print cartridge identification system 60 are distinguished from location datums 50 described above, in that the corresponding positive and negative physical features of print cartridge identification system 60 are not used to align or position print cartridge 30 within or relative to carriage 40.

In one embodiment, print cartridge identification system 60 includes two mechanical combination keys, a family key 70 to encode a family identification of print cartridge 30, and a fluid key 80 to encode a fluid identification of print cartridge 30. Family key 70 includes corresponding physical features provided on mating surfaces of print cartridge 30 and carriage 40 to identify an association of print cartridge 30 with carriage 40 and, more specifically, an association of print cartridge 30 with printing system 10. As such, family key 70 is used to distinguish print cartridge 30 based on an associated printing system.

Fluid key 80 includes corresponding physical features provided on mating surfaces of print cartridge 30 and carriage 40 to identify a property of fluid within print cartridge 30. The property of fluid within print cartridge 30 includes, for example, a color of fluid or ink within print cartridge 30, such as black, red, green, blue, etc., a spectral response of fluid within print cartridge 30, such as fluid only visible in ultraviolet (UV) or infra-red (IR) range, a security feature of fluid within print cartridge 30, or any other property of fluid within print cartridge 30.

In one embodiment, family key 70 and fluid key 80 each include corresponding positive and negative physical features provided on mating surfaces of print cartridge 30 and carriage 40. The corresponding positive and negative physical features help prevent wrongful or improper insertion of print cartridge 30 into carriage 40 and, in one embodiment, prevent electrical connection between print cartridge 30 and printing system 10 if print cartridge 30 is an incorrect print cartridge 30 for printing system 10. For example, the corresponding positive and negative physical features prevent electrical connection between electrical contacts 36 of print cartridge 30 and electrical contacts 46 of carriage 40. Thus, by preventing electrical connection between electrical contacts 36 of print cartridge 30 and electrical contacts 46 of carriage 40 if a wrong or improper print cartridge 30 is installed in carriage 40, print cartridge identification system 60 ensures that only correct and proper print cartridges function in printing system 10.

In one embodiment, as illustrated in FIGS. 2 and 3, family key 70 includes a contact area 72 of print cartridge 30 and a protrusion 74 of carriage 40, with protrusion 74 provided on end wall 402 of carriage 40, and contact area 72 provided on side 33 of housing 32 such that contact area 72 is sized to receive and accommodate protrusion 74 when print cartridge 30 is inserted into carriage 40. In addition, fluid key 80 includes a protrusion 82 of print cartridge 30 and a receptacle 84 of carriage 40, with protrusion 82 provided on side 33 of housing 32, and receptacle 84 provided in end wall 402 of carriage 40 such that receptacle 84 is sized to receive and accommodate protrusion 82 when print cartridge 30 is inserted into carriage 40. In one embodiment, family key 70 and fluid key 80 are provided along edges of side 33 of housing 32 and along edges of end wall 402 of carriage 40. Although family key 70 is illustrated as including mating and corresponding rectangular shapes and areas of print cartridge 30 and carriage 40, and fluid key 80 is illustrated as including mating and corresponding circular shapes and areas of print cartridge 30 and carriage 40, it is understood that other shapes and/or configurations may be used for family key 70 and/or fluid key 80.

As illustrated in the embodiment of FIG. 4, print cartridge 30 is positioned in carriage 40 for operation in printing system 10. When print cartridge 30 is positioned in carriage 40, side 33 of housing 32 is positioned adjacent end wall 402 of carriage 40 such that side 33 of housing 32 and end wall 402 of carriage 40 provide mating surfaces of print cartridge 30 and carriage 40. As such, family key 70 and fluid key 80, as provided for print cartridge 30 and carriage 40, identify print cartridge 30 for use with carriage 40. More specifically, family key 70 and fluid key 80 ensure that print cartridge 30 is a proper print cartridge for carriage 40.

Figure 5:
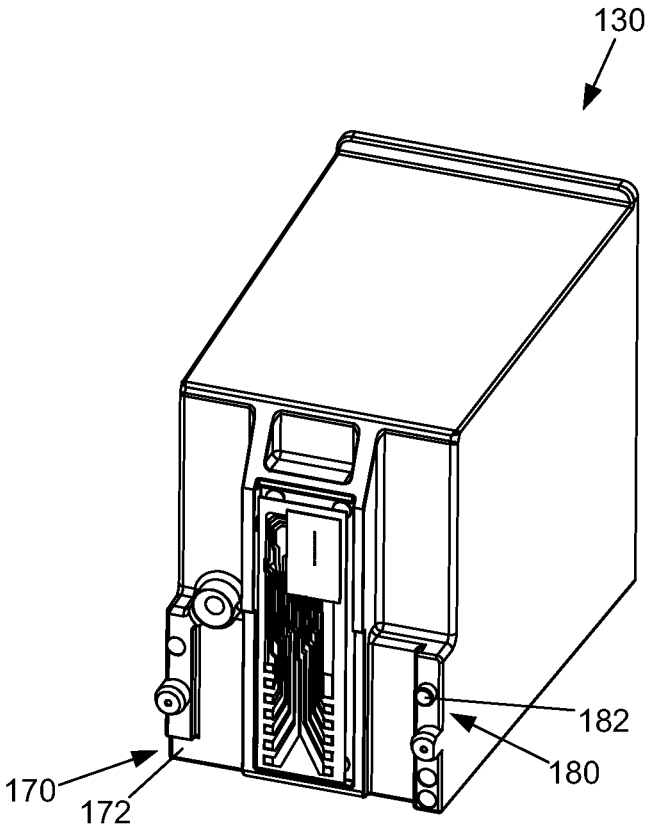
FIG. 5 is a perspective view illustrating another embodiment of a print cartridge for an inkjet printing system.
Figure 6:
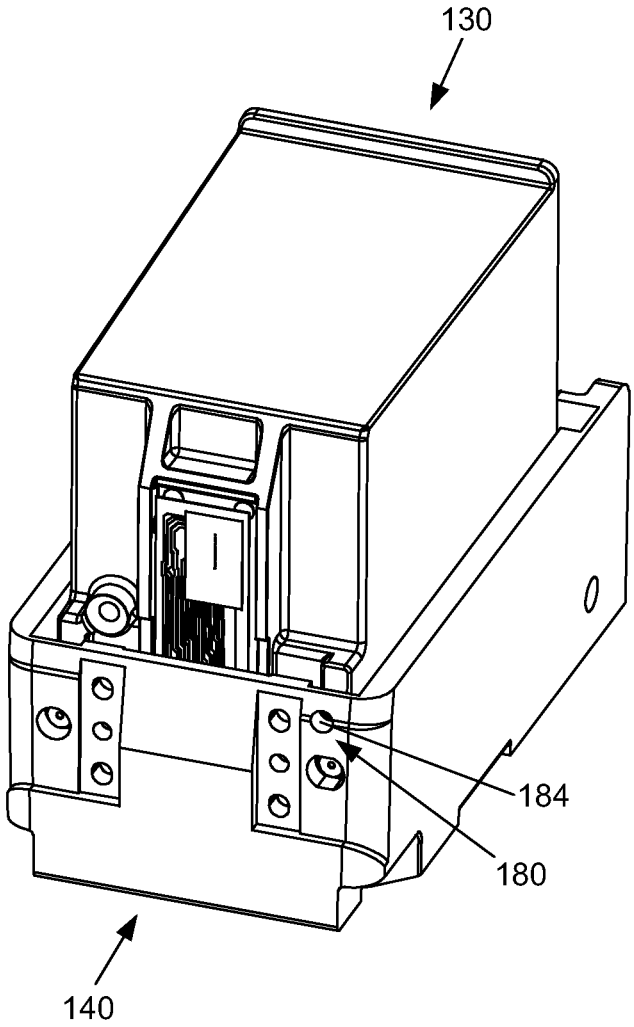
FIG. 6 is a perspective view illustrating one embodiment of the print cartridge of FIG. 5 in a carriage of an inkjet printing system.
Figure 7:
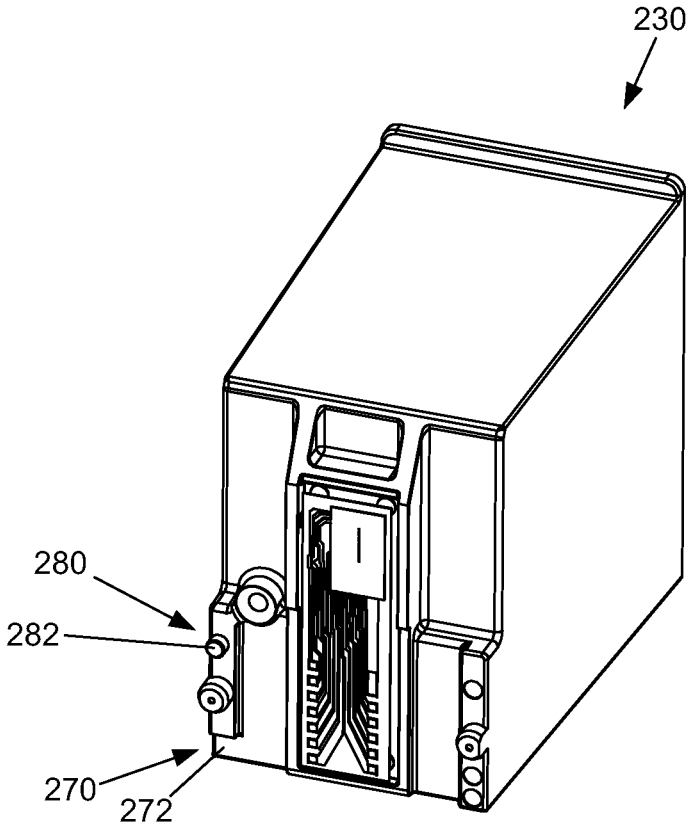
FIG. 7 is a perspective view illustrating another embodiment of a print cartridge for an inkjet printing system.
Figure 8:
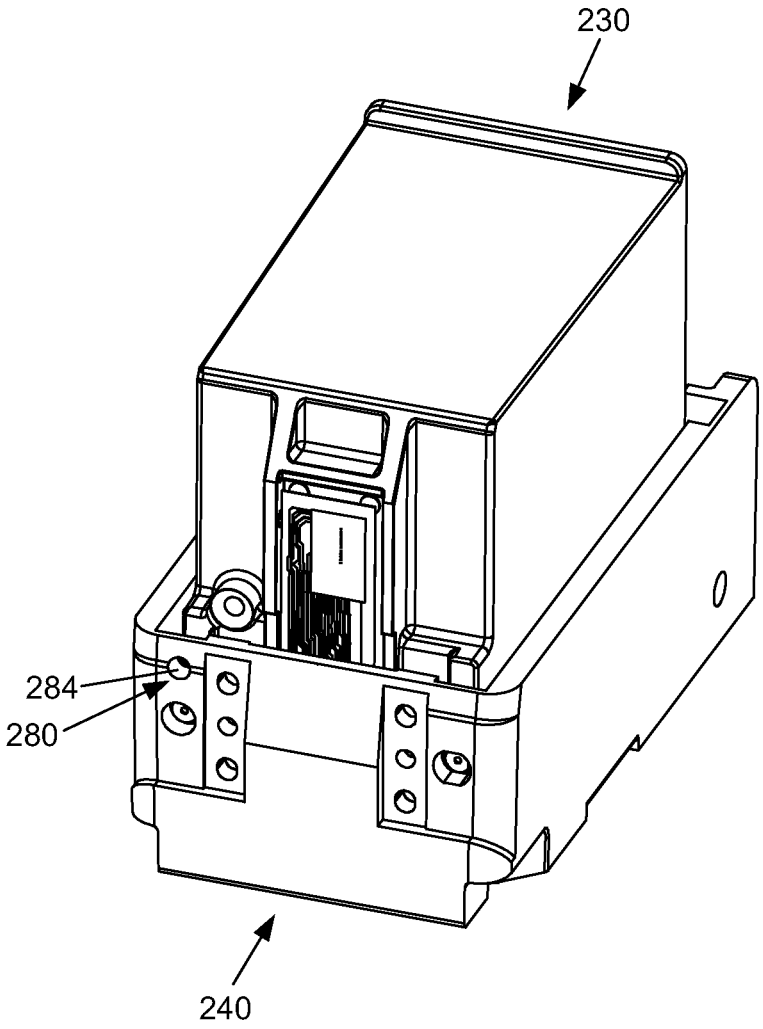
FIG. 8 is a perspective view illustrating one embodiment of the print cartridge of FIG. 7 in a carriage of an inkjet printing system.
Figure 9:
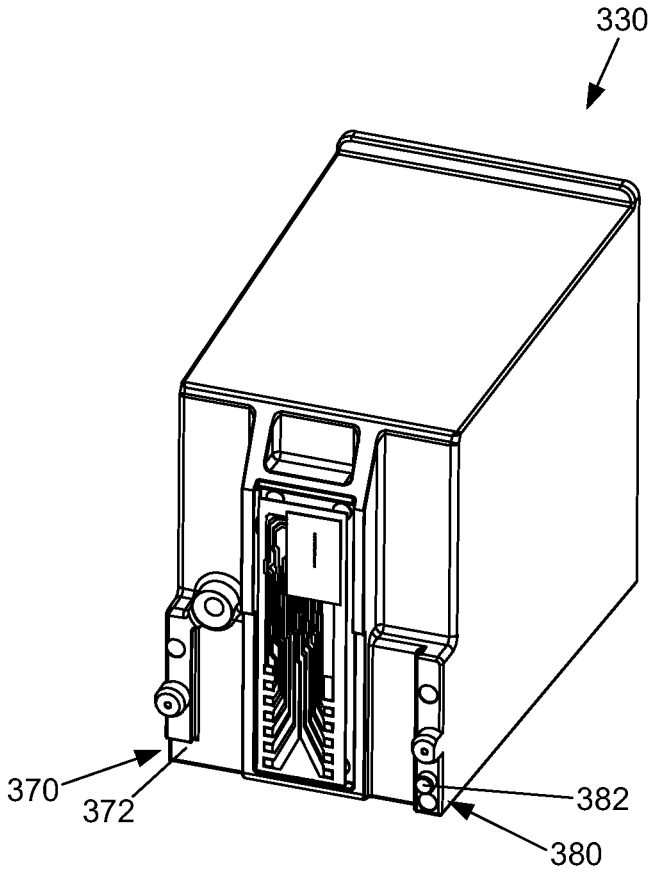
FIG. 9 is a perspective view illustrating another embodiment of a print cartridge for an inkjet printing system.
Figure 10:
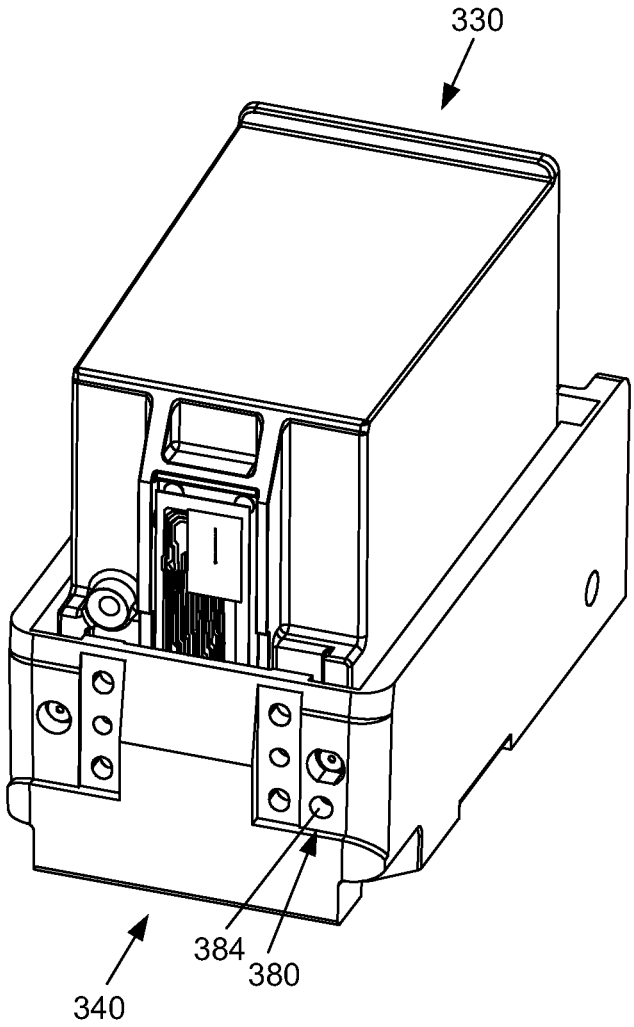
FIG. 10 is a perspective view illustrating one embodiment of the print cartridge of FIG. 9 in a carriage of an inkjet printing system.

FIGS. 5 and 6, FIGS. 7 and 8, and FIGS. 9 and 10 illustrate additional embodiments of family key 70 and fluid key 80 for other print cartridges and corresponding carriages of printing system 10. More specifically, FIGS. 5 and 6 illustrate print cartridge 130 and carriage 140 with corresponding family keys 170 and corresponding fluid keys 180, FIGS. 7 and 8 illustrate print cartridge 230 and carriage 240 with corresponding family keys 270 and corresponding fluid keys 280, and FIGS. 9 and 10 illustrate print cartridge 330 and carriage 340 with corresponding family keys 370 and corresponding fluid keys 380. In one embodiment, as described below, print cartridge 130, print cartridge 230, and print cartridge 330 include different colors of ink for printing system 10.

As illustrated in the embodiment of FIGS. 5 and 6, family key 170 includes contact area 172 of print cartridge 130 and a corresponding protrusion of carriage 140, and fluid key 180 includes protrusion 182 of print cartridge 130 and receptacle 184 of carriage 140. In one embodiment, contact area 172 of print cartridge 130 is the same as contact area 72 of print cartridge 30 (FIG. 2), and the corresponding protrusion of carriage 140 is the same as protrusion 74 of carriage 40 (FIG. 3). As such, family key 170 identifies print cartridge 130 as being of the same family as print cartridge 30 and, more specifically, as being associated with the same printing system as print cartridge 30.

Protrusion 182 of print cartridge 130, however, is different from protrusion 82 of print cartridge 30 (FIG. 2) in that protrusion 182 is in a different location than protrusion 82. Correspondingly, receptacle 184 of carriage 140 is also in a different location than receptacle 84 of carriage 40 (FIG. 4). As such, fluid key 180 identifies print cartridge 130 as including fluid or ink having a different property than fluid or ink included in print cartridge 30. For example, print cartridge 130 includes ink of a color different than ink in print cartridge 30.

As illustrated in the embodiment of FIGS. 7 and 8, family key 270 includes contact area 272 of print cartridge 230 and a corresponding protrusion of carriage 240, and fluid key 280 includes protrusion 282 of print cartridge 230 and receptacle 284 of carriage 240. In one embodiment, contact area 272 of print cartridge 230 is the same as contact area 72 of print cartridge 30 (FIG. 2) and contact area 172 of print cartridge 130 (FIG. 5), and the corresponding protrusion of carriage 240 is the same as protrusion 74 of carriage 40 (FIG. 3), as well as the protrusion of carriage 140 (FIG. 6). As such, family key 270 identifies print cartridge 230 as being of the same family as print cartridge 30 and print cartridge 130 and, more specifically, as being associated with the same printing system as print cartridge 30 and print cartridge 130.

Protrusion 282 of print cartridge 230, however, is different from protrusion 82 of print cartridge 30 (FIG. 2) and protrusion 182 of print cartridge 130 (FIG. 5) in that protrusion 282 is in a different location than protrusion 82 and protrusion 182. Correspondingly, receptacle 284 of carriage 240 is also in a different location than receptacle 84 of carriage 40 (FIG. 4) and receptacle 184 of carriage 140 (FIG. 6). As such, fluid key 280 identifies print cartridge 230 as including fluid or ink having a different property than fluid or ink included in print cartridge 30 or print cartridge 130. For example, print cartridge 230 includes ink of a color different than ink in print cartridge 30 and print cartridge 130.

As illustrated in the embodiment of FIGS. 9 and 10, family key 370 includes contact area 372 of print cartridge 330 and a corresponding protrusion of carriage 340, and fluid key 380 includes protrusion 382 of print cartridge 330 and receptacle 384 of carriage 340. In one embodiment, contact area 372 of print cartridge 330 is the same as contact area 72 of print cartridge 30 (FIG. 2), contact area 172 of print cartridge 130 (FIG. 5), and contact area 272 of print cartridge 230 (FIG. 7), and the corresponding protrusion of carriage 340 is the same as protrusion 74 of carriage 40 (FIG. 3), as well as the protrusion of carriage 140 (FIG. 6), and the protrusion of carriage 240 (FIG. 8). As such, family key 370 identifies print cartridge 330 as being of the same family as print cartridge 30, print cartridge 130, and print cartridge 230 and, more specifically, as being associated with the same printing system as print cartridge 30, print cartridge 130, and print cartridge 230.

Protrusion 382 of print cartridge 330, however, is different from protrusion 82 of print cartridge 30 (FIG. 2), protrusion 182 of print cartridge 130 (FIG. 5), and protrusion 282 of print cartridge 230 (FIG. 7), in that protrusion 382 is in a different location than protrusion 82, protrusion 182, and protrusion 282. Correspondingly, receptacle 384 of carriage 340 is also in a different location than receptacle 84 of carriage 40 (FIG. 4), receptacle 184 of carriage 140 (FIG. 6), and receptacle 284 of carriage 240 (FIG. 8). As such, fluid key 380 identifies print cartridge 330 as including fluid or ink having a different property than fluid or ink included in print cartridge 30, print cartridge 130, or print cartridge 230. For example, print cartridge 330 includes ink of a color different than ink in print cartridge 30, print cartridge 130, and print cartridge 230.

By identifying the family and fluid of print cartridge 30 (including print cartridges 130, 230, and 330), print cartridge identification system 60 including, more specifically, family keys 70 (including family keys 170, 270, and 370) and fluid keys 80 (including fluid keys 180, 280, and 380), helps to prevent wrongful or improper insertion of print cartridges into carriage 40 (including carriages 140, 240, and 340). More specifically, as described above, the corresponding positive and negative physical features provided on print cartridges 30, 130, 230, and 330 and corresponding carriages 40, 140, 240, and 340 allow only properly identified or keyed print cartridges to be inserted into carriages 40, 140, 240, and 340.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A print cartridge identification system, comprising:

a housing;

a printhead provided on one side of the housing to eject drops of fluid in a direction substantially perpendicular to the one side of the housing;

a family key provided on the one side of the housing to identify an associated printer of the print cartridge;

a fluid key provided on the one side of the housing to identify a property of fluid in the print cartridge; and a location datum provided on the one side of the housing to position the print cartridge in the associated printer.

2. The system of claim 1, wherein the family key comprises one of a positive feature and a negative feature provided on the one side of the housing.

3. The system of claim 1, wherein the fluid key comprises one of a positive feature and a negative feature provided on the one side of the housing.

4. The system of claim 1, wherein the fluid key identifies a color of printing fluid contained within the housing.

5. The system of claim 1, wherein the family key is provided along one edge of the one side of the housing and the fluid key is provided along one edge of the one side of the housing.

6. The system of claim 1, wherein the location datum comprises a first location datum provided along one edge of the one side of the housing, and a second location datum provided along an opposite edge of the one side of the housing.

7. The system of claim 1, further comprising:

a plurality of electrical contacts provided on the one side of the housing to provide electrical connection to the printhead.

8. The system of claim 1, wherein the family key comprises one of a protruding feature and a non-protruding feature provided on the one side of the housing.

9. The system of claim 1, wherein the fluid key comprises one of a protruding feature and a non-protruding feature provided on the one side of the housing.

10. The system of claim 1, wherein the family key and the location datum are aligned along one edge of the one side of the housing.

11. The system of claim 1, wherein the fluid key and the location datum are aligned along one edge of the one side of the housing.

12. The system of claim 1, wherein the family key, the fluid key, and the location datum are aligned along one edge of the one side of the housing.

13. The system of claim 1, wherein the family key is provided along at least one of a first edge of the one side of the housing and a second edge of the one side of the housing opposite the first edge, wherein the fluid key is provided along at least one of the first edge of the one side of the housing and the second edge of the one side of the housing, and wherein the location datum is provided along at least one of the first edge of the one side of the housing and the second edge of the one side of the housing.

* * * * *